US005915456A

United States Patent [19]

Niemann et al.

[11] Patent Number: 5,915,456

[45] Date of Patent: Jun. 29, 1999

[54] METHOD AND DEVICE FOR CASTING A STRAND FROM LIQUID METAL

[75] Inventors: Martin Niemann, Erlangen; Juergen Adamy, Igensdorf; Hans-Joachim Nitsche, Erlangen, all of Germany

[73] Assignee: Siemens Aktiengesellschaft, München, Germany

[21] Appl. No.: 08/915,049

[22] Filed: Aug. 20, 1997

[30] Foreign Application Priority Data

Aug. 22, 1996 [DE] Germany ..... 196 33 738

[51] Int. Cl.[6] ..... B22D 11/18; B22D 11/06; B22D 11/20

[52] U.S. Cl. ..... 164/453; 164/151.3; 164/151.1; 164/155.4; 164/155.5; 164/428; 164/480; 164/454

[58] Field of Search ..... 164/453, 151.3, 164/151.1, 155.5, 155.4, 428, 480, 454

[56] References Cited

U.S. PATENT DOCUMENTS 5,458,182 10/1995 Aoki et al. ..... 164/416

FOREIGN PATENT DOCUMENTS 44 04 148 A1 2/1994 Germany .
44 42 087 A1 11/1994 Germany .
4-9260 1/1992 Japan ..... 164/453
4-344862 12/1992 Japan ..... 164/453

*Primary Examiner*—Patrick Ryan
*Assistant Examiner*—I.-H. Lin
*Attorney, Agent, or Firm*—Kenyon & Kenyon

[57] ABSTRACT

A method and a device for casting a strand from molten metal is presented. The molten metal is poured into a mold and then pulled out of the mold as a strand having a liquid core characterized by a solidified shell and a tapering liquid pool. The pouring level associated with the rate at which the liquid metal is poured into the mold is regulated by determining the pouring level and influencing the inflow of liquid metal into the mold by means of a controller whose control parameters are adapted on-line, by means of fuzzy techniques, to any change in the parameters of the controlled system corresponding to the pouring apparatus and the mold.

11 Claims, 8 Drawing Sheets

METHOD AND DEVICE FOR CASTING A STRAND FROM LIQUID METAL

FIELD OF THE INVENTION

The present invention relates to a method and a device for casting a strand from a liquid metal in which the liquid metal is poured into a mold and pulled out of the mold as a strand having a solidified shell and molten core.

BACKGROUND OF THE INVENTION

In continuous casting (strand casting), a mold is used to cast from the liquid metal a strand that is then pulled out of the mold. One factor that is essential for good quality in a strand cast in this fashion is maintaining a constant pouring level, i.e. the rate at which the liquid metal is poured into the mold. It is already known to regulate the pouring level of the liquid metal. The controller, however, is difficult to design, since the parameters of the controlled system, i.e. the pouring apparatus and the mold, are subject in some cases to extreme fluctuations.

The inflow of liquid metal into a mold occurs, for example, via an inflow nozzle that is immersed into the liquid metal in the mold, and that has outlet openings for the discharge of the liquid metal into the mold. These outlet openings in some circumstances become smaller in the course of a pouring operation due to the settling of solidifying material. Inflow resistance increases, i.e. the controlled system is modified. As the solidified material breaks away from the outlet openings, the inflow resistance abruptly decreases, and abrupt changes occur in the controlled system. Because of these fluctuations in the controlled system, a controller cannot be optimized with respect to the controlled system.

SUMMARY OF THE INVENTION

It is an object of the present invention to provide a method and a device for casting a strand from liquid metal by means of a controller, which maintains, in better fashion than before, a constant pouring level of the liquid metal into the mold when disturbances occur.

According to the present invention, the pouring level, i.e. the rate at which the liquid metal is poured into the mold, is regulated, by determining the pouring level and influencing the inflow of liquid metal into the mold, by means of a controller which adapts the control parameters on-line, by means of fuzzy techniques, to any change in the parameters of the controlled system, i.e. of the pouring apparatus and the mold. The use of fuzzy techniques has proven particularly successful for detecting changes in the controlled system and adapting the control parameters in accordance with those changes. It is particularly advantageous in this context to constitute the control parameters by means of a fuzzy adjuster whose input variable is at least one of the following variables: an actual value of the pouring level; a system deviation of the pouring level, i.e. a difference between a setpoint and an actual value of the pouring level; or a relative system deviation of the pouring level, i.e. a quotient of the difference between the setpoint and the actual value of the pouring level, and the setpoint of the pouring level.

In this context, the relative system deviation is particularly suitable as the input variable for the fuzzy adjuster. With the relative system deviation, which is a standardized variable, it is particularly easy to set the membership functions of the fuzzy adjuster for an input variable of this kind.

In a particularly advantageous embodiment of the present invention, the membership functions are optimized on-line, the membership ranges advantageously being raised if periodic or quasi-periodic fluctuations in the actual value of the pouring level increase. On the other hand, if the periodic or quasi-periodic fluctuations in the actual value of the pouring level become less, the membership ranges of the fuzzy adjuster are also reduced.

In a further advantageous embodiment of the present invention, the control parameters are subjected to an on-line optimization in addition to the setting by the fuzzy adjuster. In on-line optimization, the control parameters are optimized to periodic or quasi-periodic disturbance variables which manifest themselves as periodic or quasi-periodic fluctuations in the actual value of the pouring level.

In a further advantageous embodiment of the present invention, the controller has a friction compensator.

DETAILED DESCRIPTION

Figure 1:
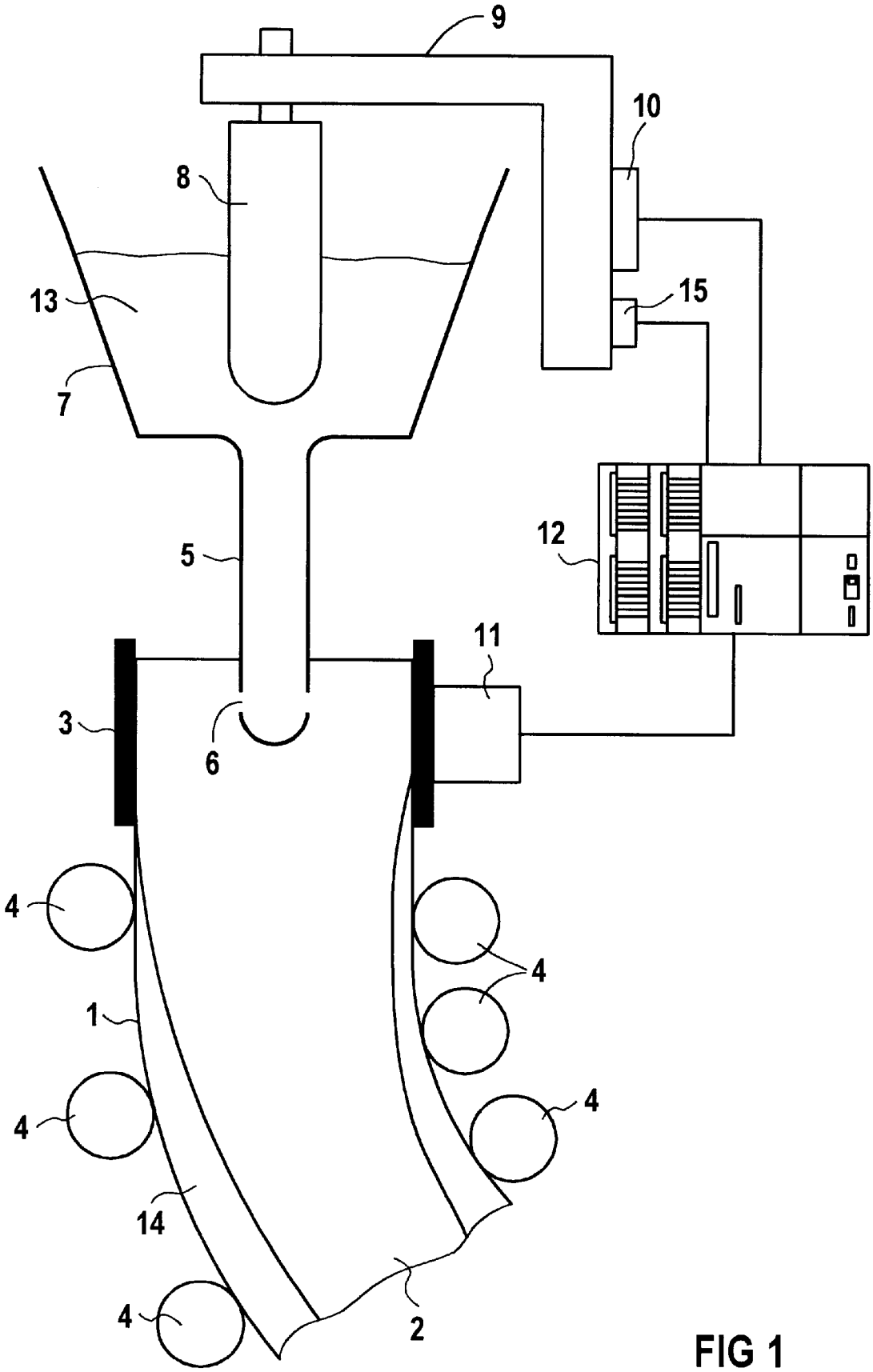
FIG. 1 schematically illustrates an arrangement for continuously casting a strand according to an embodiment of the present invention.

In an exemplifying arrangement according to FIG. 1, liquid metal 13, in this case steel, is poured into a tundish 7. From the tundish 7, the liquid steel 13 flows through a submerged nozzle 5 with an outlet opening 6 into a mold 3. In the mold 3 a strand 1 forms from the liquid steel 13. The strand 1 is then pulled out of mold 3 by rollers 4. The inflow of liquid metal 13 through submerged nozzle 5 into mold 3 is influenced by a stopper 8 that is moved by a mechanism which has a support arm and a lifting bar 9. The support arm and lifting bar 9 are in turn driven by a hydraulic cylinder 10 which is controlled or regulated by an automatic controller unit 12. The position of the support arm and lifting bar 9 is measured by means of a position measurement unit 15 and transmitted to automatic controller unit 12. The arrangement also has a mold fill level measurement unit 11 which, like position measurement unit 15 and hydraulic cylinder 10, is connected in terms of data technology to automatic controller unit 12. Automatic controller unit 12 regulates or controls the pouring level, i.e. the fill level of liquid metal 13 in mold 3. As strand 1 is pulled out of mold 3, it has a tapering liquid pool, i.e. a liquid core 2 and a solidified shell 14.

Figure 2:
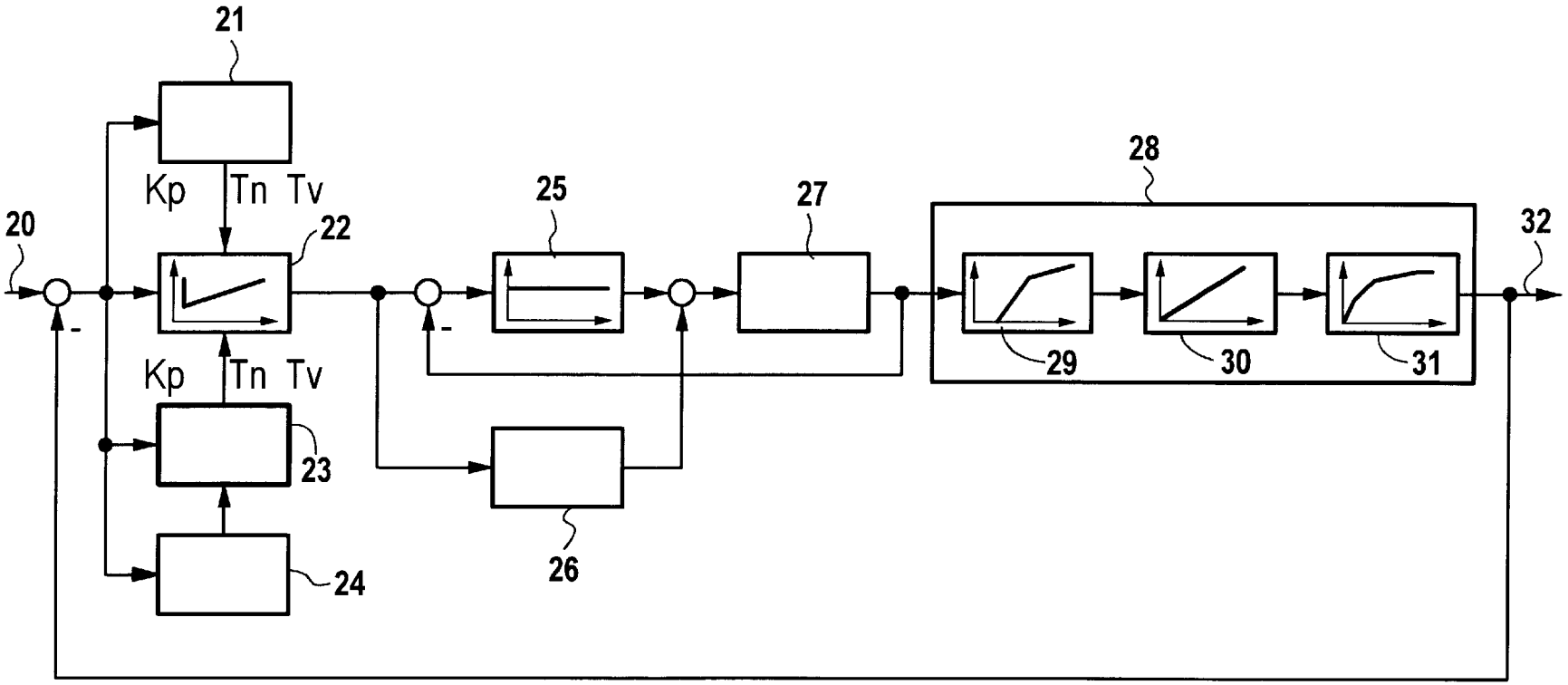
FIG. 2 shows a block diagram with a controller and controlled system according to an embodiment of the present invention.

FIG. 2 shows a block diagram of a system having a controller and controlled system 28. The essential influencing variables of controlled system 28 are stopper 29, mold 30, and mold fill level measurement 31. The controlled system 28 is regulated by means of a pouring level controller 22, which in the exemplifying embodiment is configured as a PID controller, and a positioning controller 25, which in the exemplifying embodiment is configured as a P controller. Positioning controller 25 is used to regulate hydraulic cylinder 27 to move the support arm and lifting bar 9 (shown in FIG. 1). It is possible to compensate for friction during displacement of the lifting bar 9 by means of an additional friction compensator 26. The actual pouring level control takes place in pouring level controller 22, whose parameters $K_p$, $t_n$, and $t_v$ are adapted on-line to parameter fluctuations in the controlled system 28. Large and, in particular, aperiodic fluctuations in controlled system 28 which manifest themselves in the system deviation, i.e. the difference between pouring level setpoint 20 and actual value 32 of the pouring level, are adapted to the altered system parameters by means of a fuzzy adjuster 23. For better compensation for periodic or quasi-periodic disturbances which manifest themselves as fluctuations in the system deviation, parameters $K_p$, $t_n$, $t_v$ of pouring level controller 22 are optimized by an on-line control optimizer 21 as a function of that disturbance. To prevent fuzzy adjuster 23 from reacting in an undesired fashion to such periodic or quasi-periodic disturbances, the latter is also adapted to periodic or quasi-periodic disturbances which manifest themselves as fluctuations in the system deviation. For this purpose, the membership functions of the fuzzy adjuster 23 are changed by means of a fuzzy optimizer 24. If the periodic or quasi-period disturbances in controlled system 28 affect the system deviation as large periodic or quasi-period fluctuations, fuzzy optimizer 24 enlarges the membership functions of fuzzy adjuster 23 in such a way that it does not interpret the fluctuation as a system deviation. In the case of smaller-amplitude fluctuations, the fuzzy optimizer 24 correspondingly reduces the width of the membership functions of fuzzy adjuster 23.

Figure 3:
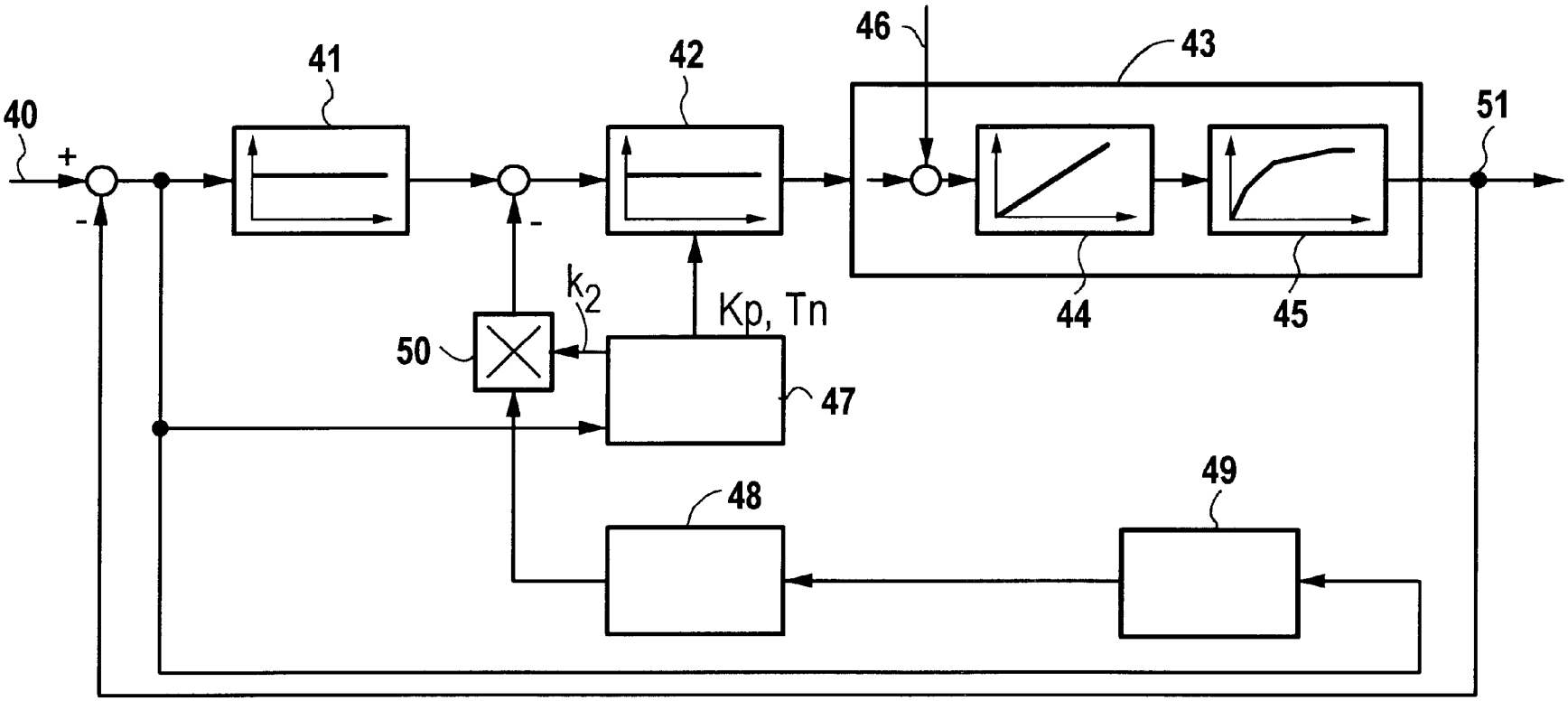
FIG. 3 shows a block diagram with a controller and controlled system according to an embodiment of the present invention.

FIG. 3 shows the interaction between fuzzy adjuster 47 and the pouring level controller 22, in greater detail than in the exemplary embodiment of FIG. 2. The pouring level controller 22, as shown in FIG. 3, has a P controller 41, a PI controller 42, a block 49 to form the numerical derivative, a digital filter 48, and a multiplier 50. Controlled system 43, indicated by a mold 44, a mold fill level measurement 45, and disturbance variables 46, supplies actual value 51 of the pouring level. Based on the difference between pouring level setpoint 40 and actual value 51 of the pouring level, fuzzy adjuster 47 forms parameters $K_p$ and $t_n$ of PI controller 42, and a constant $k_2$. The difference between pouring level setpoint 40 and actual value 51 of the pouring level is also numerically differentiated in functional block 49, and smoothed in digital filter 48. The output value of digital filter 48 is multiplied by constant $k_2$ by means of multiplier 50. The output value of multiplier 50 is subtracted from the output value of P controller 41, the input variable of which is the system deviation, i.e. the difference between pouring level setpoint 40 and actual value 51 of the pouring level. The difference between the output signal of P controller 41 and the output signal of multiplier 50 is the output variable of PI controller 42, which determines the adjusting variable for controlled system 43.

Figure 4:
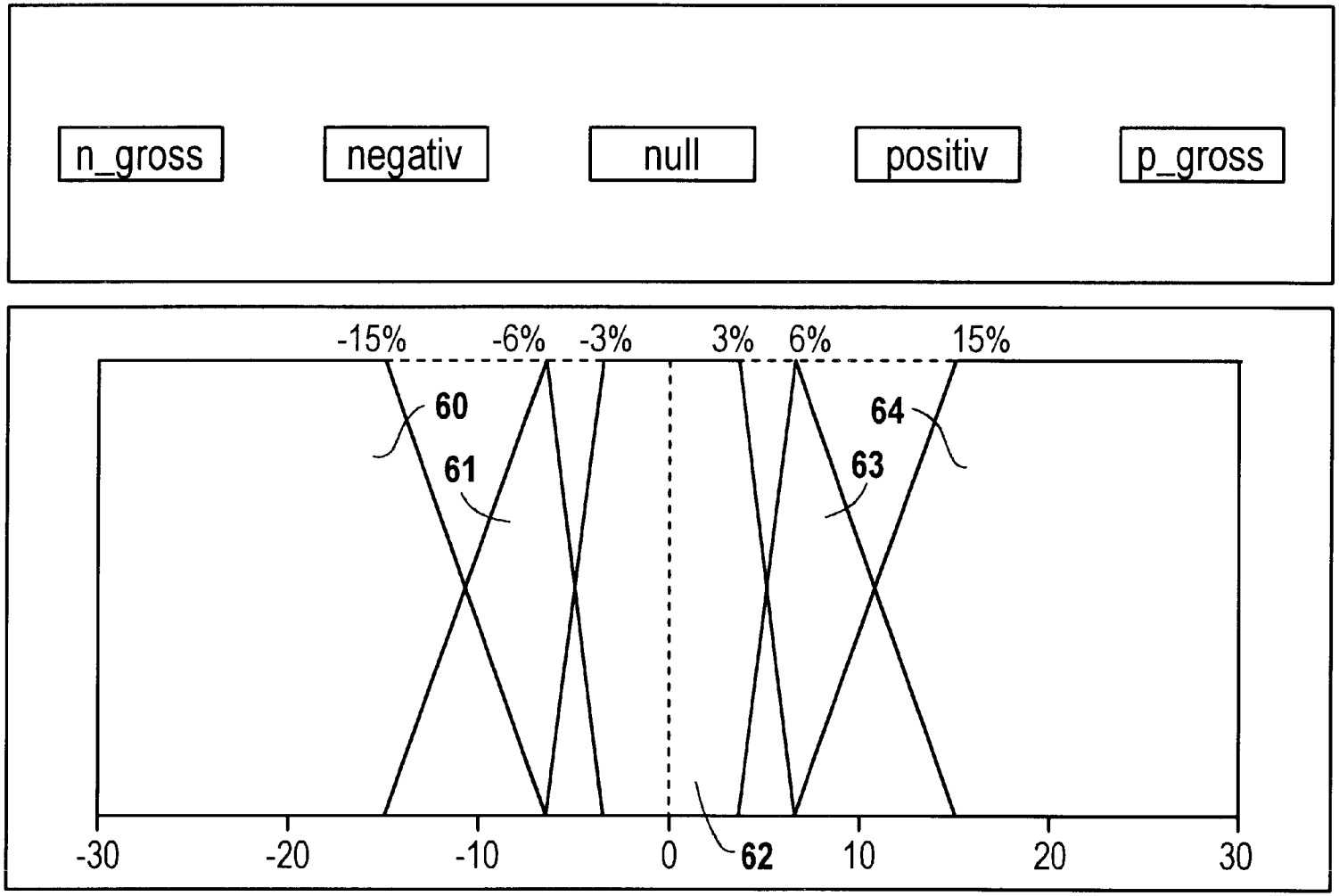
FIG. 4 shows membership functions for a system deviation according to an embodiment of the present invention.
Figure 5:
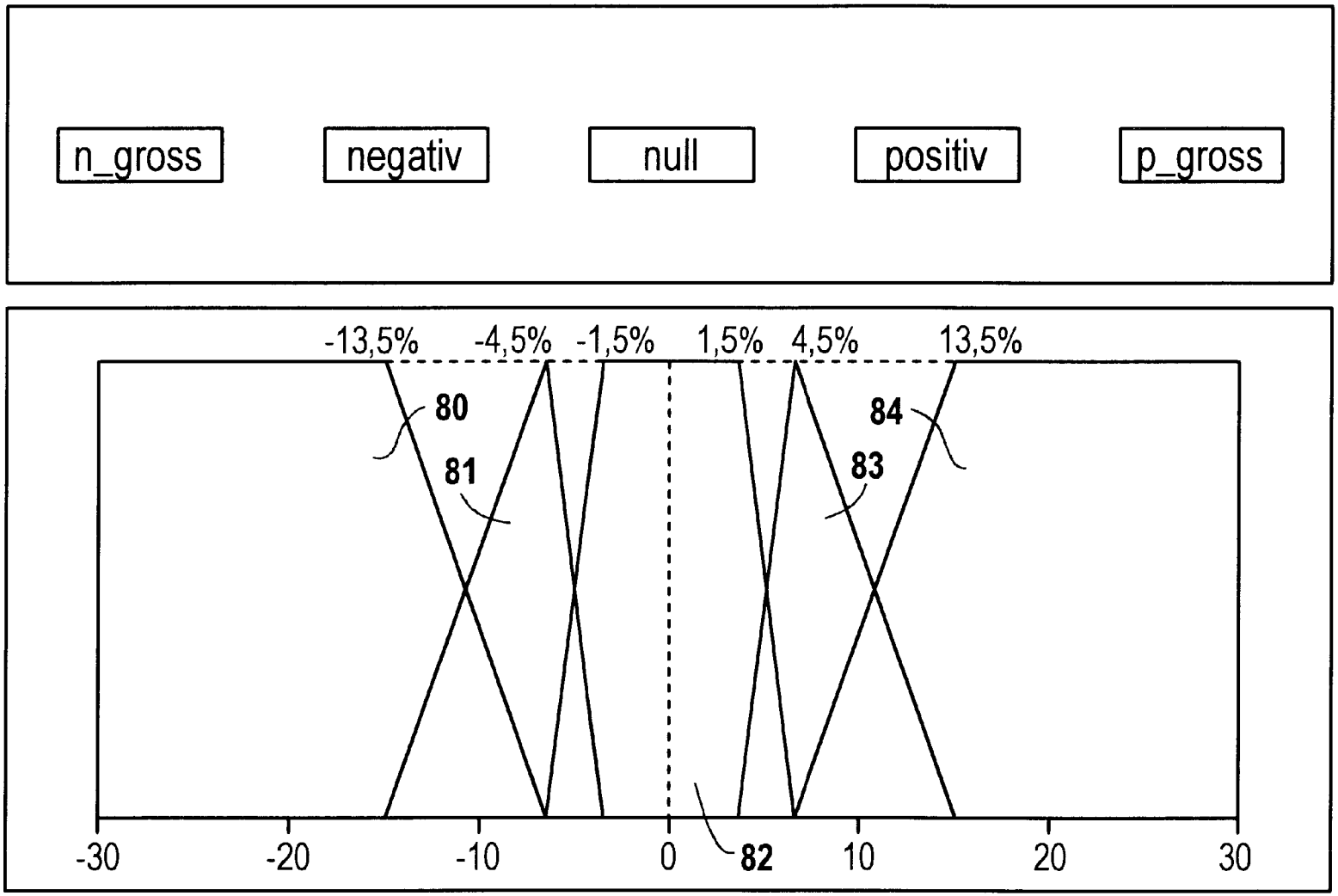
FIG. 5 shows membership functions for a system deviation according to an embodiment of the present invention.

FIG. 4 shows an example of membership functions of the fuzzy adjuster 23, 47. In this, the range within which the relative system deviation can move is divided into five membership functions: large-negative 60, negative 61, zero 62, positive 63, and large-positive 64. According to the arrangement of FIG. 2, these membership functions of the fuzzy adjuster 23 are influenced by a fuzzy optimizer 24. For example, if the fluctuations in the system deviation or the relative system deviation decrease, the fuzzy optimizer 24 reduces the range width of the membership functions. This is done, for example, in FIG. 5. In the case of smaller periodic or quasi-period fluctuations in the relative system deviation, the control points of the membership functions, as shown in FIG. 5, are moved closer to the zero axis. In FIG. 5, reference character 80 designates the large-negative membership function, reference character 81 the negative membership function, reference character 82 the zero membership function, reference character 83 the positive membership function, and reference character 84 the large-positive membership function.

Figure 6:
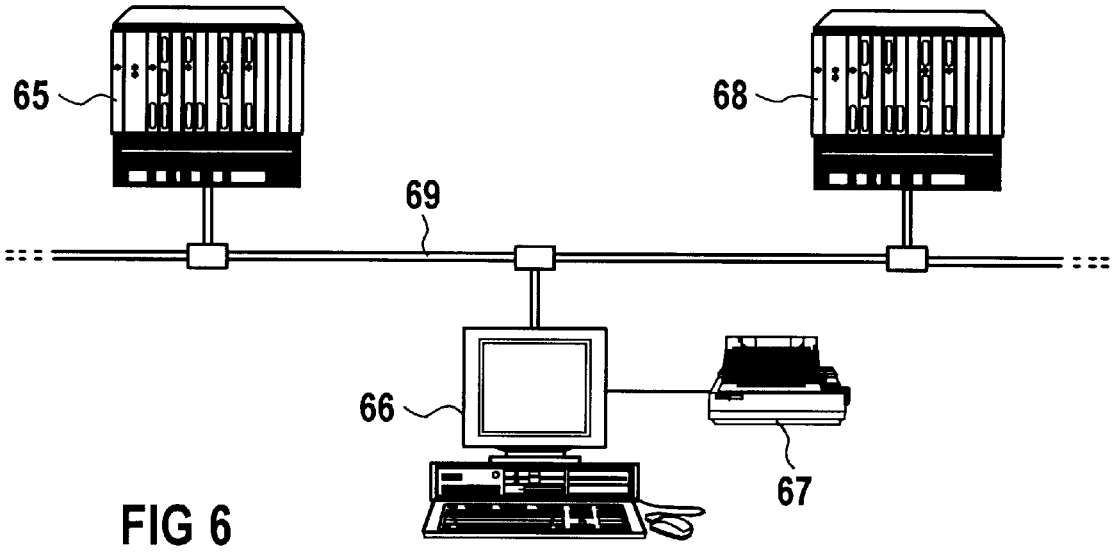
FIG. 6 shows a hardware structure for controlling or regulating continuous-casting facilities.

FIG. 6 shows a hardware structure for controlling or regulating continuous-casting systems. In this context, in which multiple continuous-casting systems are present, one programmable control system 65, 68, connected via a bus system 69 to one another and to a PC 66, is used for each continuous-casting system. The pouring level controller 22, positioning controller 25, on-line control optimizer 21, fuzzy adjuster 23, 47 and fuzzy optimizer 24 are in each case implemented in the stored-program control system 65, 68. Setpoint calculation and higher-level functions, however, take place in PC 66. The system can also have a printer 67 for data logging.

Figure 7:
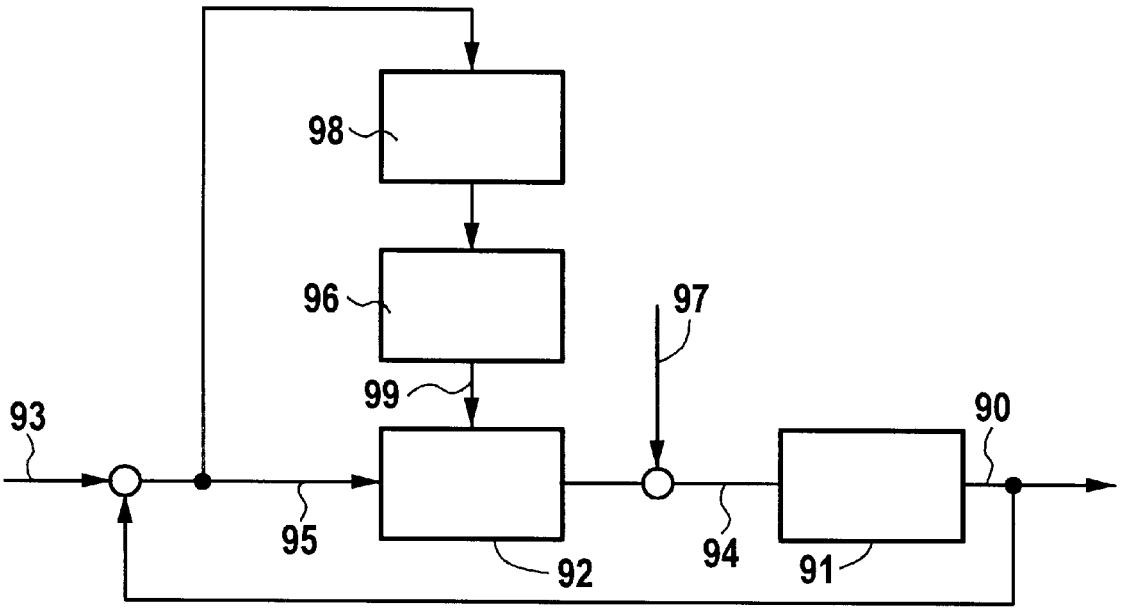
FIG. 7 shows a block diagram with an optimizer.

FIG. 7 shows the on-line control optimizer 21 of FIG. 2 in a more detailed form. Output variable 90 of controlled system 91 is regulated by controller 92 to the preset setpoint 93. Process input 94 is acted upon by disturbances 97 which cause a system deviation 95. The task of controller 92 is to minimize this system deviation 95. This process has the following characteristics:

1. The controlled system 91 is a batch process. Each batch has different process characteristics and thus requires different controller parameters.
2. The process characteristics of a batch change as the charge proceeds. The controller parameters must therefore be adapted to the process on-line.
3. Two disturbance variables 97 act on the controlled system 91 at a process input 94. The first disturbance is a statistical disturbance with a slowly varying amplitude. The second disturbance consists of abrupt disturbances of large amplitude and low frequency.

The parameters of controller 92 are adapted by an on-line optimizer 96 to the changing parameters of controlled system 91. The task of on-line optimizer 96 is to set the controller 92 at each point in time so as to minimize the system deviation 95. The system deviation 95 is minimal when the average over time of the square of the control deviation (standard deviation) is minimal.

The on-line optimizer 96 solves this problem as follows:

1. Only the effect of the statistical disturbance is considered in minimizing the system deviation, since the abrupt disturbances would falsify execution of the optimization algorithm. For this purpose, the abrupt disturbances are filtered out of the "controlled system" signal. This procedure also guarantees that the effects of abrupt disturbances will be minimized.
2. The optimizer 96 is restarted with each new batch, and the optimizer 96 calculates optimum controller parameters 99.
3. The optimizer 96 is also restarted after any significant deterioration in process parameters; new optimum controller parameters 99 are then calculated.

The optimization algorithm operates as follows:

1. Regulation begins with an initial set of controller parameters, and the standard deviation is calculated by a standard deviation calculator 98.

2. Proceeding from the initial value, controller parameters 99 are modified in one direction and the new standard deviation is calculated.

3. Controller parameters 99 are then modified so as to minimize the standard deviation.

4. The standard deviation is filtered for the on-line optimizer 96. Time-related filtering of the standard deviation is accomplished by introducing a difference value for the standard deviation. A significant change in standard deviation has not occurred until the standard deviation has changed by that difference value. Filtering of the standard deviation as a function of controller parameters 99 is achieved by taking into account at least three different controller settings for calculating the change in standard deviation as a function of controller parameters 99.

Figure 8:
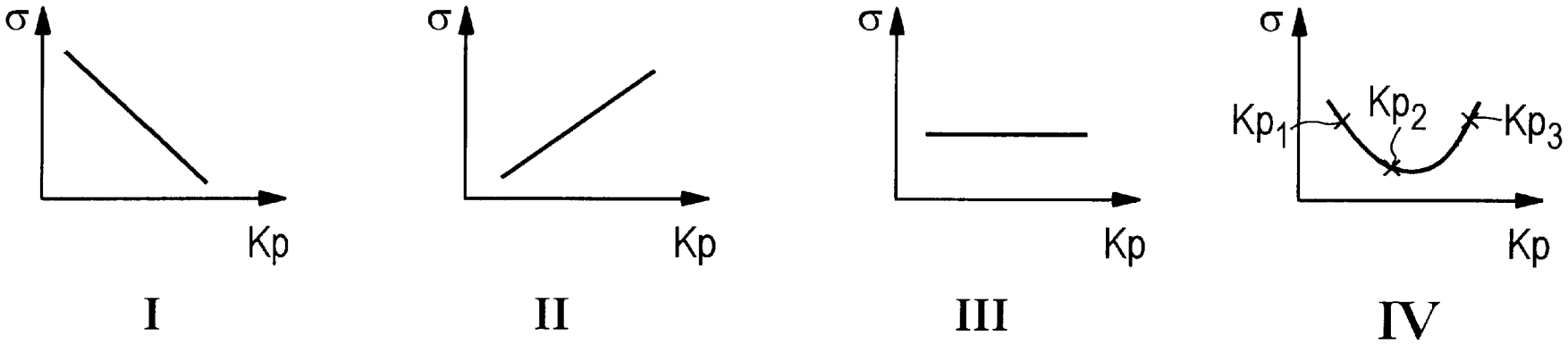
FIG. 8 shows an optimizing operation.

FIG. 8 shows how the controller parameters are adjusted, using the example of parameter $K_p$:

I. The standard deviation decreases with increasing $K_p$. $K_p$ is raised up to an upper limit.

II. The standard deviation increases with increasing $K_p$. $K_p$ is lowered down to a lower limit.

III. The standard deviation does not change when $K_p$ is changed. The step width for the change in $K_p$ is raised up to an upper limit.

IV. A standard deviation minimum lies between three different controller settings. The step width is lowered down to a lower limit so as to find the exact minimum of the standard deviation.

Figure 9:
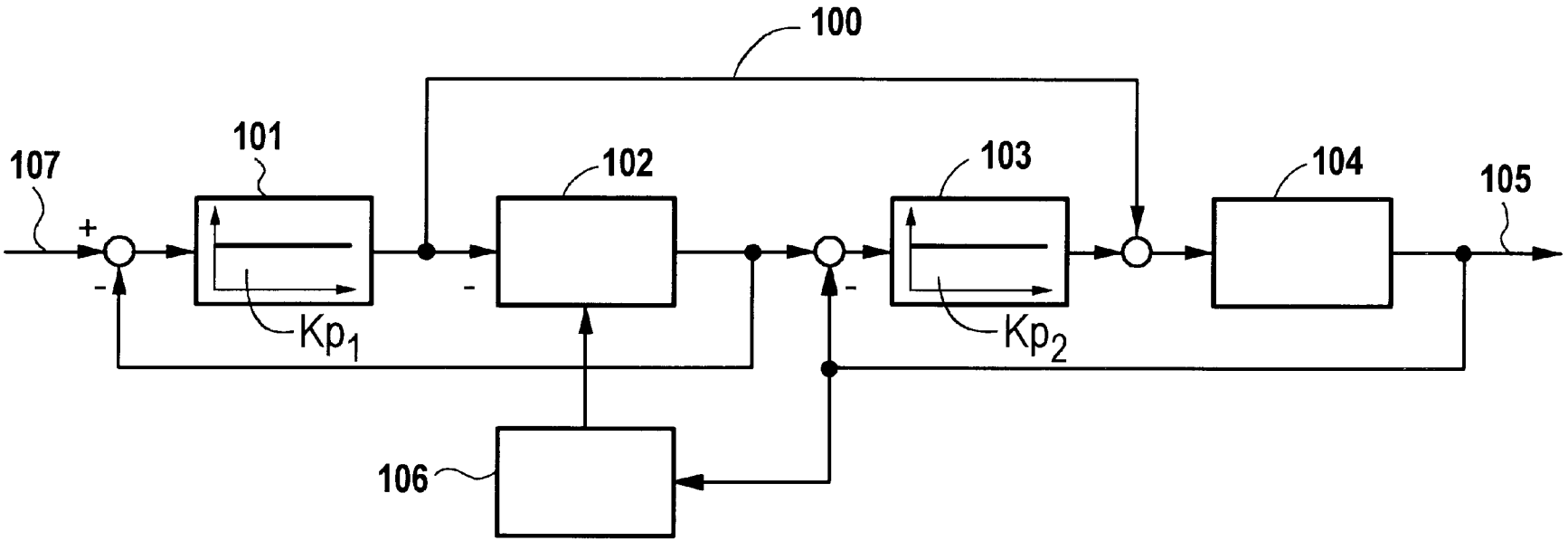
FIG. 9 shows a block diagram of a friction compensator.

FIG. 9 shows the friction compensator 26 in a more detailed form. The friction compensator 26 generates a pilot control signal 100 for the position control loop of the stopper 29, thus accelerating the position control loop. The result of this in turn is that the differences between the setpoint 107 and actual value 105 of the pouring level decrease. The position control loop consists of position controller 103, in this case a P controller, and the hydraulics 104 for stopper displacement. The pilot control signal is constituted in a model control loop which imitates the actual system. The model control loop consists of model controller 101 and a model 102 of the hydraulics. Friction in the real hydraulics 104 causes a temporary standstill in stopper position (sticking). The standstill state is determined by differentiator 106 by formation of the derivative of the stopper position. If the real hydraulic system sticks, the velocity of the hydraulics in the model control loop is also set to zero. This causes increased driving of the hydraulics by the pilot control signal, and thus decreased sticking of the real hydraulics 104.

What is claimed is:

1. A method for casting a strand from a molten metal, comprising the steps of:

pouring the molten metal through a pouring apparatus of a controlled system into a mold of the controlled system;

determining a pouring level of the molten metal in the mold;

adapting at least one first parameter of a controller on-line using a fuzzy logic system, the at least one first parameter being adapted to a change of at least one second parameter of the controlled system;

influencing the pouring level as a function of the at least one first parameter using the controller; and extracting the strand from the mold, the strand having a solidified shell and a tapering liquid pool.

2. The method as set forth in claim 1, further comprising the step of:

constituting the at least one first parameter using a fuzzy adjuster having at least one input variable, the at least one input variable being constituted as a function of at least one of an actual value of the pouring level, a system deviation value of the pouring level and a relative system deviation value of the pouring level.

3. The method as set forth in claim 2, further comprising the step of:

optimizing on-line a plurality of membership functions for the at least one input variable.

4. The method as set forth in claim 3, further comprising the step of:

adapting the plurality of membership functions as a function of one of a periodic disturbance variable of the controlled system and a quasi-periodic disturbance variable of the controlled system so that a membership range increases with an increasing amplitude of the periodic and quasi-periodic disturbances.

5. The method as set forth in claim 4, further comprising the step of:

optimizing the controller as a function of at least one of the periodic and quasi-periodic disturbances using an on-line optimizer.

6. The method as set forth in claim 2, further comprising the step of:

modifying the at least one first parameter using the fuzzy adjuster only in the event of one of a large change in the controlled system and an abrupt change in the controlled system.

7. The method as set forth in claim 2, wherein the system deviation value is determined as a function of a setpoint value and the actual value, and wherein the relative system deviation value is a difference between the setpoint value and the actual value which is divided by the setpoint value.

8. The method as set forth in claim 1, wherein the controller includes a friction compensator.

9. A device for casting a strand from a liquid metal, comprising:

a pouring apparatus pouring the liquid metal;

a mold arrangement forming a strand, the strand being extracted from the mold arrangement and having a solidified shell and a tapering liquid core; and a controller controlling the pouring of the liquid metal from the pouring apparatus into the mold arrangement, the controller determining a pouring level and influencing an inflow of the liquid metal into the mold arrangement, the controller having at least one first parameter which is adapted on-line using a fuzzy technique and adjusted as a function of a change in at least one second parameter of the pouring apparatus and the mold.

10. The device as set forth in claim 9, wherein the at least one first parameter is constituted by a fuzzy adjuster having at least one input variable constituted by at least one of an actual value of the pouring level, a system deviation value of the pouring level, and a relative system deviation value of the pouring level.

11. The device as set forth in claim 10, wherein the system deviation value is determined as a function of a setpoint value and the actual value, and wherein the relative system deviation value is a difference between the setpoint value and the actual value which is divided by the setpoint value.

* * * * *